US011124986B1

(12) United States Patent
Buehrer et al.

(10) Patent No.: US 11,124,986 B1
(45) Date of Patent: Sep. 21, 2021

(54) COLUMBARIUM SYSTEM

(71) Applicant: Window Creations, LLC, Ottoville, OH (US)

(72) Inventors: Reggie E. Buehrer, Van Wert, OH (US); Brad P. Allison, Van Wert, OH (US); Jason A. Buehrer, Van Wert, OH (US); Joshua D. Buehrer, Van Wert, OH (US)

(73) Assignee: Window Creations, LLC, Fort Jennings, OH (US)

( * ) Notice: Subject to any disclaimer, the term of this patent is extended or adjusted under 35 U.S.C. 154(b) by 0 days.

(21) Appl. No.: 16/943,798

(22) Filed: Jul. 30, 2020

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/006; E04H 13/008; E04B 2/96; E04B 2/962
See application file for complete search history.

(56) References Cited

U.S. PATENT DOCUMENTS 766,000 A * 7/1904 Shaken ..... A61G 17/00 27/35
2,280,142 A * 4/1942 Daniels ..... E04B 2/96 52/204.51
3,841,726 A * 10/1974 Andros ..... A61G 17/08 312/111
2007/0209172 A1* 9/2007 Krawczyk ..... E04H 13/008 27/35
2010/0300021 A1* 12/2010 Falk ..... E04B 2/962 52/235
2011/0126480 A1* 6/2011 Tsao ..... B44C 5/04 52/133
2015/0308141 A1* 10/2015 Berlanga ..... A61G 99/00 52/135
2017/0183889 A1* 6/2017 Rossi ..... E04H 13/008
2020/0232243 A1* 7/2020 Rossi ..... E04H 13/006

FOREIGN PATENT DOCUMENTS

KR 200406907 Y1 * 1/2006
KR 200435733 Y1 * 2/2007

* cited by examiner

*Primary Examiner* — Christine T Cajilig
(74) *Attorney, Agent, or Firm* — Snell & Wilmer LLP; Kent A. Lembke

(57) ABSTRACT

A columbarium system that facilitates simplified and less expensive manufacture and assembly. The new columbarium system includes glass or stone fronts for the niches that can be readily personalized and more readily replaced. The columbarium system includes a set of interlocking panels for creating the box or niche network by providing the walls, floors, and ceilings of the niches (or boxes). A set of extrusions or structural members are included in the system to enhance the structural integrity (e.g., vertical and horizontal stability and strength) of the assembled plates and also to receive and retain a plurality of fronts or shutters in the columbarium system. A U-shaped gasket or sealing member, which may be formed of silicone or other resilient and weather resistant material, is provided that extends about the perimeter of each front to protect each niche or box from the elements.

33 Claims, 11 Drawing Sheets

COLUMBARIUM SYSTEM

BACKGROUND

1. Field of the Description

The present invention relates, in general, to columbarium design and fabrication, and, more particularly, to a new columbarium system that is configured for ease of fabrication at reduced costs and for improved ease of use in mausoleums including ready repair and/or replacement of glass or stone (e.g., granite) fronts for individual niches.

2. Relevant Background

A columbarium is a structure designed as a final resting place to house cremated remains. Columbaria are permanent structures with banks of cremation niches to hold or entomb one or two cremation urns in a walled-in space that is enclosed with a vertical front or shutter. Some columbaria have glass-front niches (i.e., have glass fronts or shutters), which allow visitors to see the cremation urns and any personal artifacts placed with them, while other columbaria have granite or marble fronts that can be memorialized with a plaque.

A columbarium can be small or large with one-to-many niches. A columbarium can be an indoor, climate-controlled environment or an outdoor garden environment. Columbaria can be part of a cemetery or a stately standalone structure. The columbaria range from very simple to quite ornate.

There is a growing demand for new designs for columbarium as there have been very few changes for many years. For example, columbaria can be expensive to manufacture and install, especially when fabricated of marble or granite. There is a demand for new columbarium designs that are less expensive to manufacture and are easier to fabricate and install as standalone units or within existing structures of mausoleums. Also, there is a demand for alternative ways to personalize the fronts or shutters to replace or supplement conventional plaques. Further, it can be challenging to repair broken or damaged fronts as the design of the columbarium may require that all or numerous ones of the fronts be removed to access the damaged one, and it may be difficult or impossible to match the look or pattern of the front with a replacement front when the original fronts were all fabricated of marble or granite taken from a particular vein within a quarry.

SUMMARY

With the above design issues in mind, a columbarium system is presented that facilitates simplified and less expensive manufacture and assembly. The new columbarium system may include glass or stone (e.g., granite, marble, or the like) fronts or shutters for the niches that can be readily personalized and more readily replaced. The columbarium system includes a set of interlocking plates (without the need for fasteners or other hardware) for creating the box or niche network by providing the walls, floors, and ceilings of the niches (or boxes). A set of extrusions or structural members are included in the system to enhance the structural integrity (e.g., vertical and horizontal stability and strength) of the assembled plates and also to receive and retain a plurality of fronts or shutters in the columbarium system. A U-shaped gasket or sealing member, which may be formed of silicone or other resilient and weather resistant material, is provided that extends about the perimeter of each front to protect each niche or box from the elements. Specialty screws or fasteners (e.g., "security screws") each having a unique head requiring a matching tool/driver to install are used on exposed or external portions of the system to retain the extrusions in place with enhanced security.

More particularly, a columbarium system is provided that includes a plurality of planar panels interlocked together to define a floor, a ceiling, and two spaced-apart and parallel sidewalls of each of a plurality of niches for receiving one or more urns. The columbarium system also includes a plurality of fronts or shutters (glass or granite) at a plurality of locations in the columbarium system so that each covers an opening to one or more of the niches with a planar body extending from the floor to the ceiling and across the two sidewalls of that niche/box. Further, the columbarium system includes a plurality of extrusions (e.g., aluminum-bodied components with uniform cross-sections formed by extruding) coupled to the panels and supporting the fronts in the locations so that the planar bodies are orthogonal to the planar panels.

In some embodiments of the columbarium system, each of the panels includes at least one groove at a predefined distance along a length of the panel. The groove extends a distance from an edge of the panel. The panels are divided into first and second sets (vertical and horizontal, for example) with an equal number of the panels, and the first and second sets are interlocked together by arranging the first set orthogonal to the second set with at least one groove at matching locations. In some cases, the first and second sets each contain at least three of the panels, the panels have matching widths and lengths, and the distance that each of the grooves extends is one half the width of the panel.

In some preferred embodiments, the columbarium system includes one or more sealing members extending about a periphery of each of the fronts to be disposed between outer edges of the planar body and the extrusions. In particular, the one or more sealing members may each be provided as a U-shaped silicone gasket.

In the same or other embodiments of the columbarium system, the extrusions may include a plurality of main beam extrusions mating with and supporting interior edges of the planar bodies of the fronts. Each of the main beam extrusions has a body detachably coupled along a first side with an edge of one of the panels. The body of each of the main beam extrusions further may include a pair of elongate lips or walls extending outward from opposite sides of the body defining along with planar surfaces of the body a pair of slots each for receiving an edge of the planar body of one of the fronts. In such embodiments, the extrusions further may include a plurality of face trim extrusions each having an elongate, planar body. A number of the face trim extrusions can then be fastened to the body of the main beam extrusions, whereby first and second portions of the elongate, planar body of the face trim extrusions are parallel to and spaced apart a distance from the lips of the body of the main beam extrusions to define a wall of each of the pair of slots for receiving one of the fronts. Further, the face trim extrusions can be coupled to the body of the main beam extrusion using two or more tamper-resistant screws that extend through the elongate, planar body of the face trim extrusions into the body of the main beam extrusion.

In the same or other implementations, the extrusions may include at least two perimeter extrusions and a plurality of face trim extrusions. Then, each of the perimeter extrusions can be provided at one of a top edge, a bottom edge, or a side edge of the columbarium system. Further, each of the perimeter extrusions may include a body having a first lip extending outward from the body and being affixed to a front edge of one of the panels and having a second lip extending outward from the body to be orthogonal to the first lip and to define along with a planar outer surface a slot for receiving an edge of the planar body of one of the fronts. The face trim extrusions each may have an elongate, planar body that is coupled to a recessed surface on the body of one of the perimeter extrusions, whereby a portion of the elongate, planar body of the face trim extrusion is parallel to and spaced apart a distance from the second lip of the body of the perimeter extrusion to define a wall of the slot for receiving the edge of the planar body of one of the fronts.

The columbarium system may be implemented such to include corner support elements received in recessed corners of each of the interlocked panels and affixed to the panels to enhance system rigidity. Then, the extrusions may include a pair of corner extrusions extending along and fastened to a pair of outer and vertical ones of the corner supports. Each of the corner extrusions may include a body with a recessed groove for receiving an outer edge of the planar bodies of the fronts positioned over outer side ones of the niches. Additionally, the extrusions further may include a pair of corner trim extrusions each fastened over one of the corner extrusions and with a body including an arm extending over the outer edge of the planar bodies of the fronts to retain the fronts within the recessed groove.

DETAILED DESCRIPTION

Embodiments described herein are directed to a columbarium system (or, more simply, a columbarium) that is uniquely designed to simplify repair and use and to reduce the complexity and material costs associated with fabrication and assembly. The following description explains how the design and configuration of the individual system components, such as extrusions, provide a new and unique way of fabricating and assembling a columbarium. Further, the system design provides a new way of attaching and holding in place a front or shutter to cover/enclose each niche through the use of the set of extrusions (e.g., aluminum or other metal structural members), which includes use of a silicone (or other material) gasket to keep the weather and elements out of each niche.

Additionally, the new columbarium system may include fronts or shutters (and side plates in some cases) formed of printed decorative glass, which in combination may present a larger image such as a religious, patriotic, or other-themed mural when viewed from a first distance (e.g., from 6 to 12 feet or more) and which may individually be etched to present personalized content for each niche and/or allow some level of viewing of the niche contents (e.g., the print may be or include translucent-to-transparent portions) when viewed from a second distance (e.g., less than the first distance such as from 6 feet or less). Laser etching may also be incorporated onto the front surface of the face trim extrusions if etching is not desired on the surface of the glass or granite fronts or shutters (or in addition to such etching on the fronts/shutters).

The following figures illustrate one useful embodiment or implementation of a columbarium system of the present description. Specifically, the figures illustrate how the columbarium unit or system is fabricated and assembled with the set or system of extrusions holding the glass or stone (e.g., granite) front within the columbarium system. In one useful prototype, the extrusions were formed by extruding aluminum and were secured to the plates (e.g., formed of stainless steel, aluminum, or other sheet metal) using stainless steel screws (or other fasteners).

Figure 1:
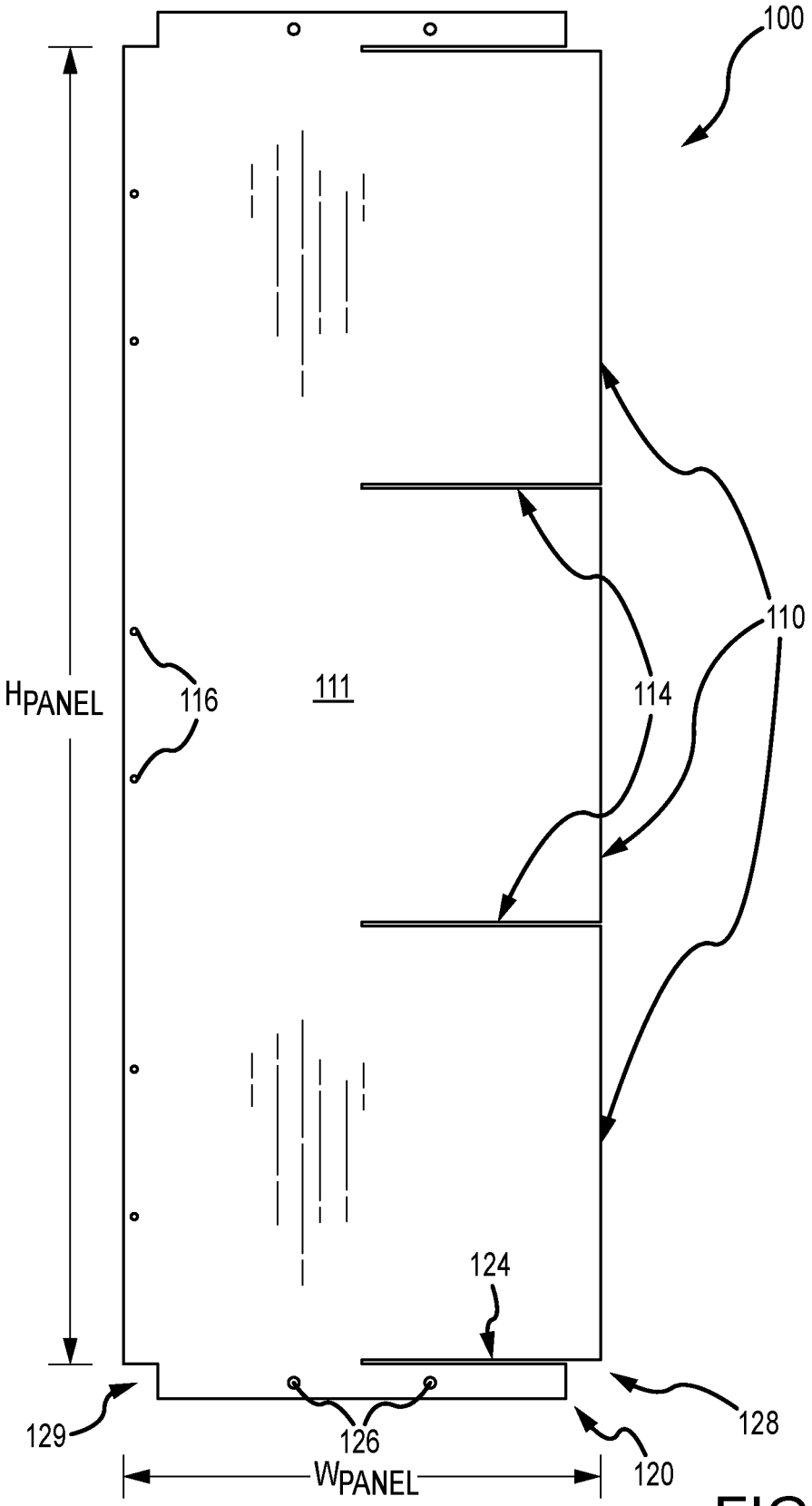
FIG. 1 is a plan view of an interlocking (or interlockable) panel or plate for use in assembling a columbarium system of the present description and, with a number of other such plates, to provide walls, floors, and ceilings of a plurality of niches or boxes.

FIG. 1 is a plan view of an interlocking (or interlockable) panel or plate 100 for use in assembling a columbarium system of the present description (such as system 300 shown in FIG. 3) and, with a number of other such plates, to provide walls, floors, and ceilings of a plurality of niches or boxes. The interlocking panel 100 has a planar body that may be formed or cut from metal sheet, such as stainless steel, aluminum, or other corrosion-resistant sheet metal of a wide range of thicknesses or gauges (e.g., 5/64 to 1/4 inch) to provide a desired strength and/or rigidity of the fabricated columbarium. The body of the panel 100 has a height (or length), $H_{Panel}$, and a width, $W_{Panel}$. The height, $H_{Panel}$, may be chosen to define a height and a width of a columbarium (such as in the range of 3 to 6 foot more on each dimension), which may be square in configuration (equal height and width) or rectangular (differing height and width). The width, $W_{Panel}$, may be chosen to define a depth of the niches/boxes of the columbarium, such as in in the range of 9 to 18 inches or more (with some prototype designs defining 1 foot by 1 foot by 1 foot square niches).

The body of the interlocking panel 100 is divided into two or more niche segments 110 (with three shown but it being understood that four or more may be provided). The division is provided by an intermediate slot or groove 114 extending between the segments 110, and these slots/grooves 114 are linear and extend orthogonal to a longitudinal axis of the body of the panel 100. The outer edges or sides or outer ones of the segments 110 are defined by outer slots or grooves 124 that are also linear and extend parallel to intermediate slots/groove 114, and the outer slots 124 further define an end segment or tag 120 on each end of the body of the interlocking panel 100. The spacing between the slots 114 and between the slots 114 and slots 124 defines a width of each niche/box of the columbarium, and this spacing may be any useful size such as in the range of 10 to 18 inches or more with a spacing of about 12 inches used in the 1-foot square niche embodiment.

Figure 2:
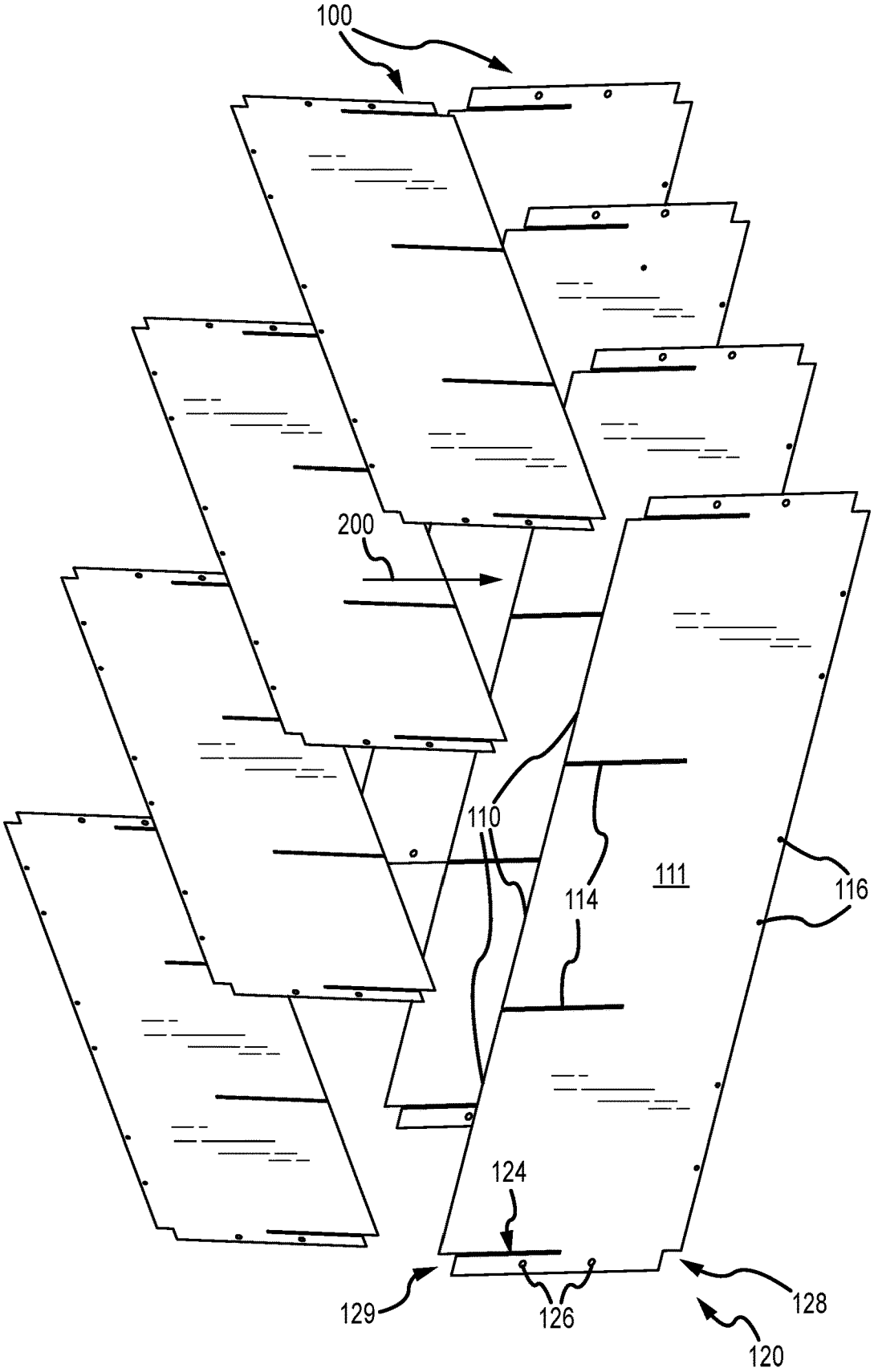
FIG. 2 is a top perspective view of a system or set of interlocking panels, as shown in FIG. 1, during an initial assembly step for a columbarium system of the present description.

The slots 114 and 124 are used to assemble or "interlock" a set or plurality of the panels 100. FIG. 2 is a top perspective view of a system or set of interlocking panels 100 during an initial assembly step for a columbarium system of the present description. Arrow 200 is used to show how a set or plurality of horizontally oriented panels 100 are interlocked with a set or plurality of vertically oriented panels 100 to form a system or set of interlocking panels defining a plurality or niche network of columbarium boxes by defining the sidewalls, ceilings, and floors of each niche/box.

As shown, the slots 114 and the slots 124 of the mating panels 100 are aligned to interconnect the panels 100 into a network/system defining the columbarium niches. The depths or lengths of the slots 114 and 124 define the amount of structural overlap or interlocking length between the horizontal and vertical panels 100, and this typically will be chosen to be half the panel width, $W_{Panel}$, to provide "full" interlocking so as to cause the horizontal panels 100 to have rear edges that are located in the plane containing rear edges of the vertical panels 100 or to have coplanar edges (and, similarly, to have front edges that are in the plane containing the front edges of the vertical panels). When assembled, the first set of panels (three, four (as shown) or more of panels 100) remains orthogonal to the second set of panels (a matching number such as three, four (as shown) or more of panels 100), whereby the first set of panels 100 may be used as vertical sidewalls of the columbarium niches/boxes while the second set of panels 100 may be used as horizontal floors and ceilings of the columbarium niches/boxes.

The end segments/tags 120 each includes fastener receiving holes 126 for use in affixing, in some cases, the columbarium with fasteners (SS screws or the like) to a columbarium support structure (not shown), and the end segments/tags 120 each includes rectangular (e.g., square as shown in FIG. 1) corner recessed surfaces 128 and 129 for receiving corner or edge support elements (e.g., sections or lengths of 1-inch by 1-inch (or larger or smaller) tubular aluminum stock or the like) to more rigidly bind a network of the interlocking panels after their assembly (as seen in FIG. 2). Further, each of the niche segments 110 is shown in FIG. 1 to include a pair of fastener receiving holes 116 along a front edge of the panel 100 ("front" when assembled into the network as shown in FIG. 2 so as to be proximate to the front or outer side of the niches of the columbarium), and these holes 116 are used to fasten the various extrusions discussed below to the panels 100. Two spaced apart and centered (on front edge of panel segments 110) are shown but a larger number may be used in some implementations.

Figure 3:
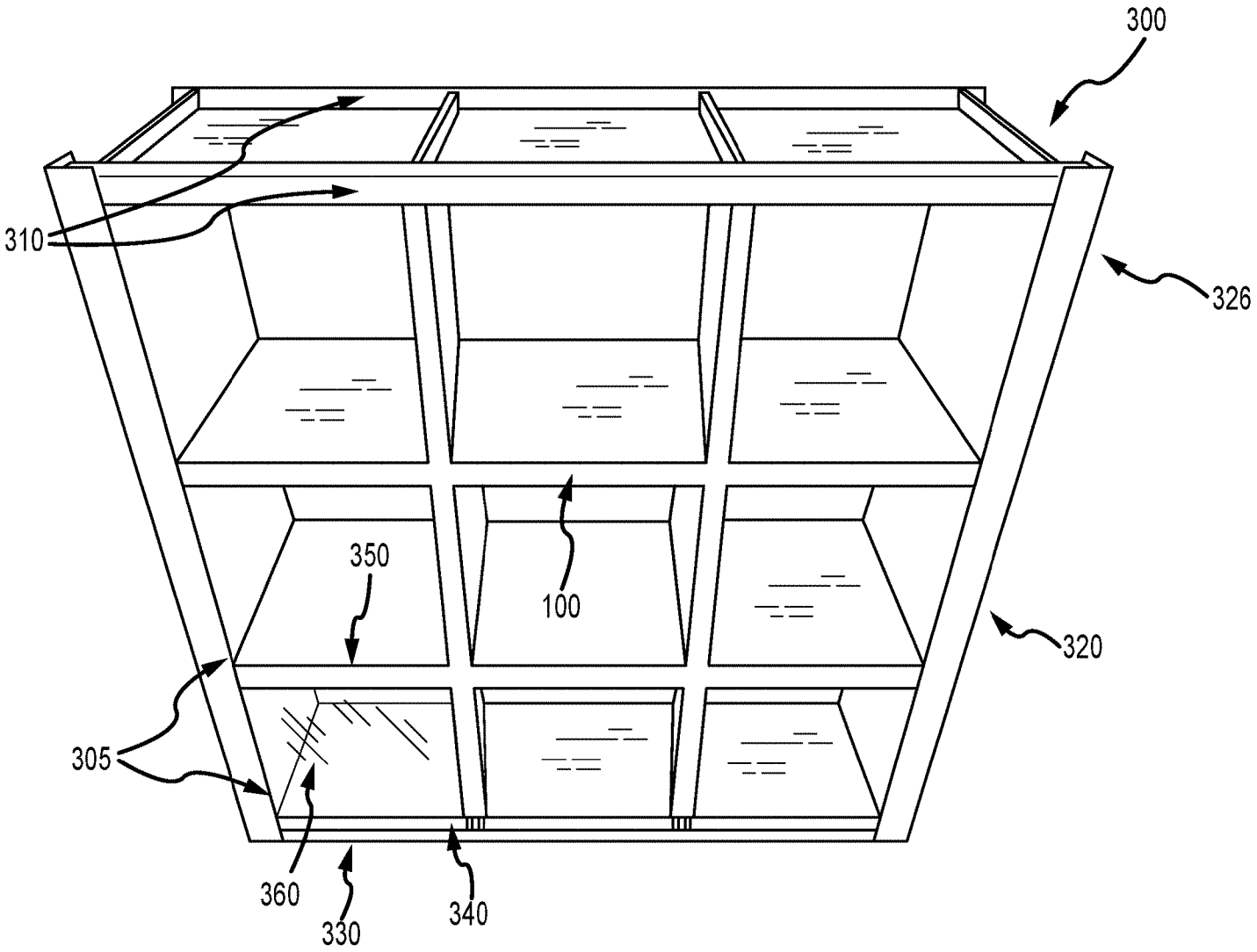
FIG. 3 is a front and top perspective view of a partially assembled columbarium system or unit including the interlocked or assembled network of panels/plates after completion of the assembly shown in FIG. 2.

FIG. 3 is a front and top perspective view of a partially assembled columbarium system or unit 300 including the interlocked or assembled network of panels/plates 100 after completion of the assembly shown in FIG. 2. Note, many of the structural components or elements of the system 300 are labeled "extrusions" because the inventors have determined that these components can readily and cost-effectively be formed by extruding metal such as aluminum as these components have been designed as elongate member that each have a uniform cross-sectional shape or configuration along their lengths. However, it is recognized that other fabrication techniques may be used to form these components and extrusion processes are not required to implement the columbarium system 300.

In the columbarium system 300, a plurality of niches or boxes 305 are provided through the assembly of the interlocking panels 100 as discussed with reference to FIGS. 1 and 2. The system 300 is shown at a state of assembly prior to the attachment of one of the main beam extrusions to show a front edge of one of the horizontal interlocking panels 100. In the system 300, nine square (e.g., 1 foot by 1 foot or the like) niches 305 are provided through the use of eight of the interlocking panels 100. In FIG. 3, corner or edge support members 310 have been placed into the recessed surfaces 128, 129 of the end segments/tags of the panels 100 so as to strengthen the system or network of panels 100 and to provide locations or places for a number of the extrusions of the system 300 to be secured or fastened. As shown, the corner support members 310 run horizontally and also vertically in each corner of the system 300, and the members 310 may be provided in the form of tubular metal (e.g., aluminum, SS, or the like) stock that is chosen both for its strength (e.g., 1-inch square tubular stock or the like) and also to be corrosion resistant when the columbarium is to be positioned in an outdoor environment.

To enclose each niche 305, a front or shutter 360 is mounted within the columbarium system 300 so as to provide a front cover or wall of the niche 305. The front 360 is a planar member or body sized and shaped to extend about the perimeter of the niche 305 defined by the interlocked panels 100 (such as to be about a 1 foot by 1 foot planar square or the like). The front 360 is shown to be formed of transparent glass (e.g., a tempered plate glass or the like with a thickness in the range of 0.25 to 0.5 inches (with ⅜-inch used in some embodiments) selected to provide a desired strength and resistance to fracture). As discussed herein, the front or outer surface of such glass front 360 may be etched or otherwise treated to form a portion or section of a larger image provided by the combination of the fronts 360. In other embodiments, the front/shutter 360 may be formed of a stone such as marble, granite, or the like.

To hold and retain the fronts 360 in place, the columbarium system 300 includes a set of five uniquely designed extrusions that work effectively in combination with each other and with the panels 100 to provide this function and to also facilitate independent installation and repair/replacement of the fronts without requiring complete disassembly. As shown in FIG. 3, the set of extrusions includes corner extrusions 320, corner trim extrusions 326, perimeter extrusions 330, face trim extrusions 340, and main beam extrusions 350.

The corner extrusions 320 extend vertically, from the top edge to the bottom edge of the columbarium system 300, over the corner support elements 310, and, as explained in more detail below, the corner extrusions 320 provide an outer groove or slot for receiving one (i.e., the outer) edge or side of the outer fronts/shutters 360 when installed in the system 300. The corner trim extrusions 326 may be provided as shown as a decorative component when the system 300 is provided as a standalone unit rather than mounted within an existing wall or location. Two perimeter extrusions 330 are included in the system 300 and are mounted on the bottom and top edges of the front of the system 300, and they provide an outer groove or slot for receiving a second one (i.e., the bottom or top outer) edge or side of the bottom or top fronts/shutters 360. In some cases, the perimeter extrusions 330 are also used in place of the corner extrusions 320, such as when it is fully surrounded by brick, stone, wood, or some other building material.

The set of extrusions further includes a main mean extrusion 350 that is mounted to outer edges/sides of panels 100 interior to the corner and perimeter extrusions 320 and 330 to provide grooves/slots for receiving the interior sides/edges of the fronts/shutters 360. A set of face trim extrusions 340 are provided that mount to the perimeter extrusions 330 and main beam extrusions 350 to retain fronts/shutters 360 against the corner and perimeter extrusions 310 and 330 after the fronts 360 are placed in the grooves/slots (or channels) defined by these components. With this overview in mind, it may be useful to provide more detail of each of the various extrusions and how their design facilitates retention of fronts 360 within the system 300.

Figure 4:
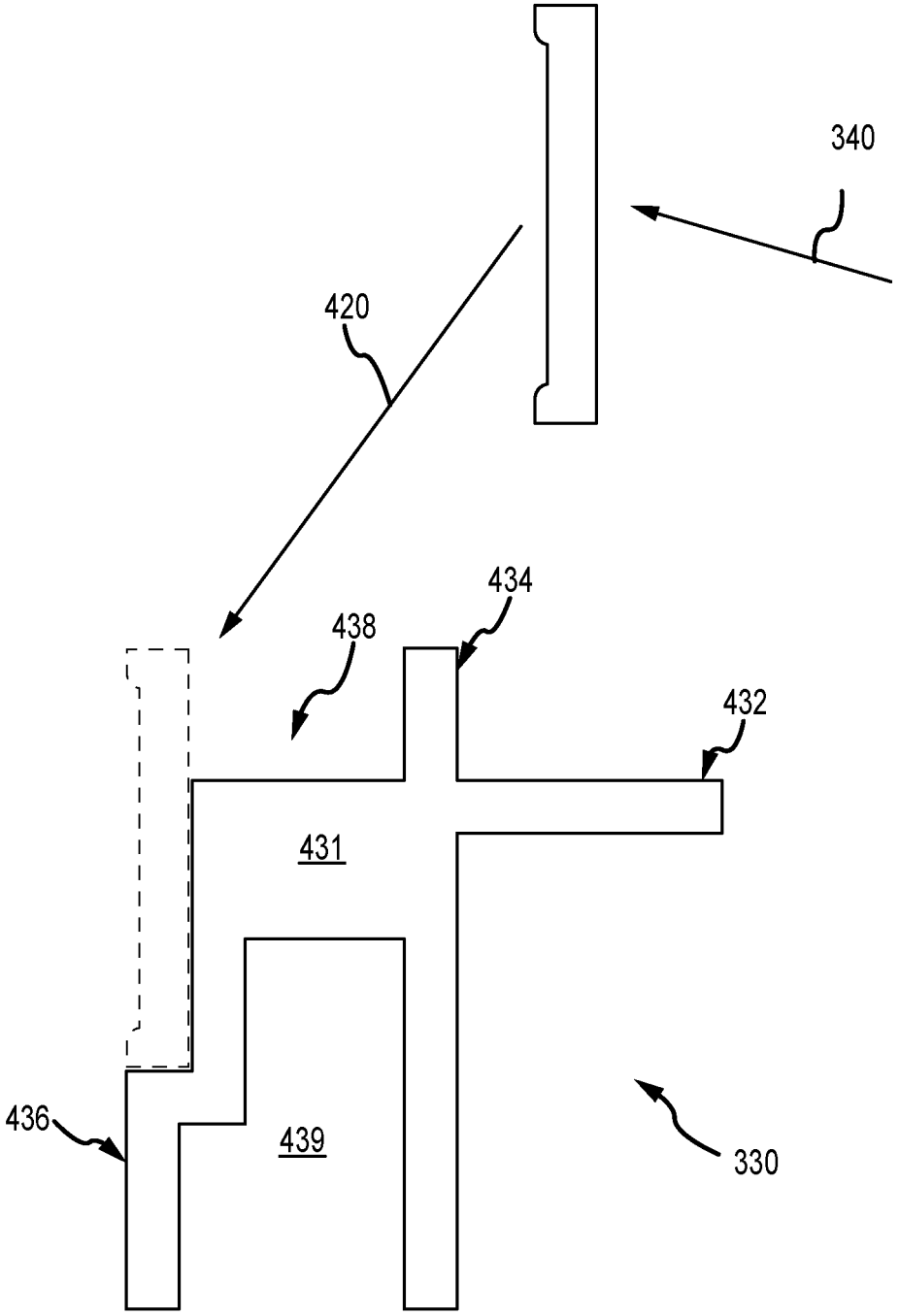
FIG. 4 is an end view of a perimeter extrusion showing mounting of a face trim extrusion upon its body.

FIG. 4 is an end view of a perimeter extrusion 330 showing the mounting, with arrow 420, of a face trim extrusion 340 upon its body 431. As shown, the body 431 of the perimeter extrusion 330 includes a first lip or wall 434 that extends along the length of the body 431 (into the page of FIG. 4) and outward a short distance (e.g., 0.25 to 0.5 inches or the like) from the planar surface of the body 431 defining the groove or channel 438. The groove/channel 438 is sized and shaped to match the edge of a glass or granite front 360, such as square as shown with the lip/wall 434 being orthogonal to the planar surface of the body 431 adjacent the lip 434.

The body 431 has an outward or external face or side 436 with a recessed surface for receiving the face trim extrusion 340 (e.g., defining a ridge for abutting a lower (or upper) edge of the face trim extrusion 340), and the body 431 typically will include two or more threaded holes (not shown) for receiving fasteners (e.g., tamper-resistant screws as discussed below). This final assembly would take place after insertion of a front or shutter 360 into the channel 438 to securely hold this edge of the front 360 in the system 300, with a length of the body of the face trim extrusion extending parallel to the lip/wall 434 (e.g., a length of 0.25 to 0.5 or the like matching the height of the lip 434). A second lip or wall 432 is included that extends along the length of the body 431 (into the page of FIG. 4) and outward a short distance (e.g., 0.25 to 0.75 inches or the like) from the body 431 away from the first lip/wall 434, and the second lip or wall 432 is configured to provide an overlapping segment of the extrusion body 431 that can mate with an outer edge of a panel 100 and be attached (with fasteners such as SS screws or the like) to the panel 100 during assembly of the columbarium system 300 (e.g., prior to insertion of fronts 360). As shown, the body 431 further includes a groove or void space 439 inward of the surface/side 436 that is optionally included to reduce the amount of material used to form the extrusion 330, without unduly limiting its strength. Its shape and size may be varied to practice the system 300 with the L-shape shown being only one example for removing 30 to 50 percent or more of the material that would otherwise be provided in the body 431.

Figure 5:
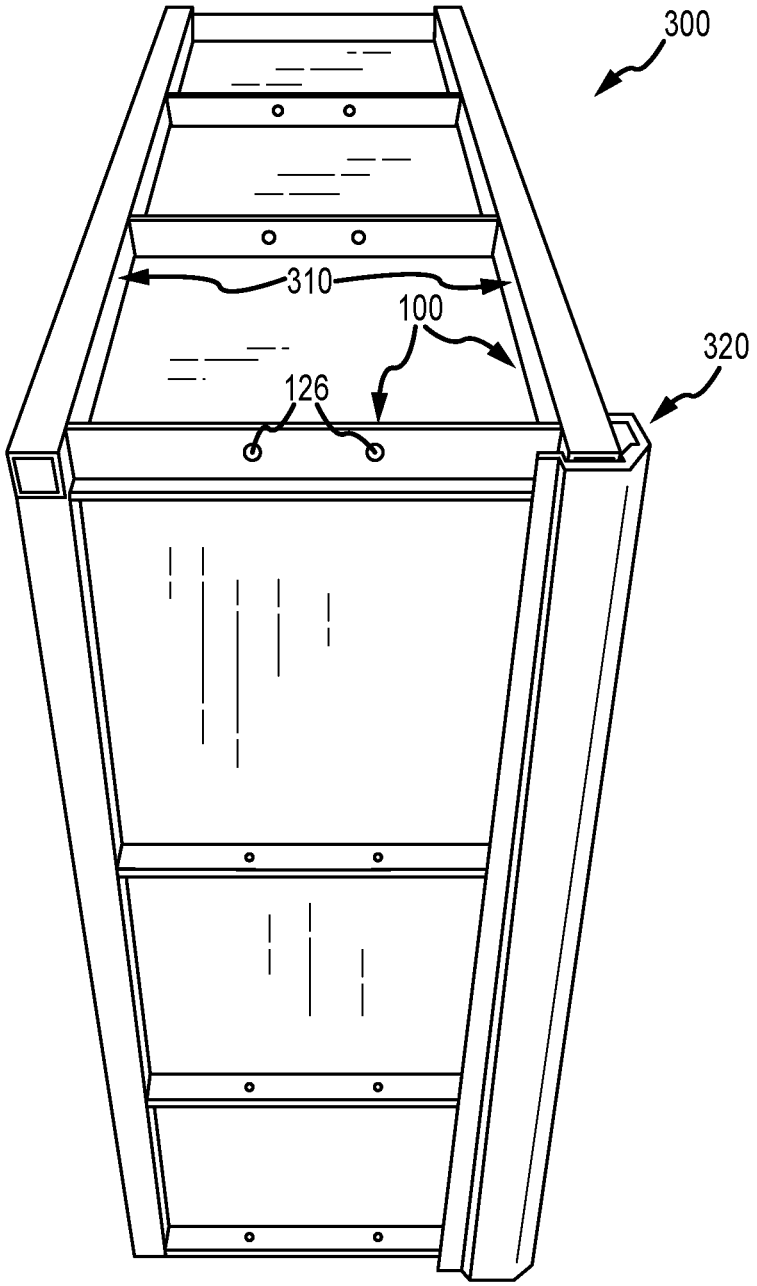
FIG. 5 is a side view of the columbarium system of FIG. 3 showing attachment of a corner extrusion.
Figure 6:
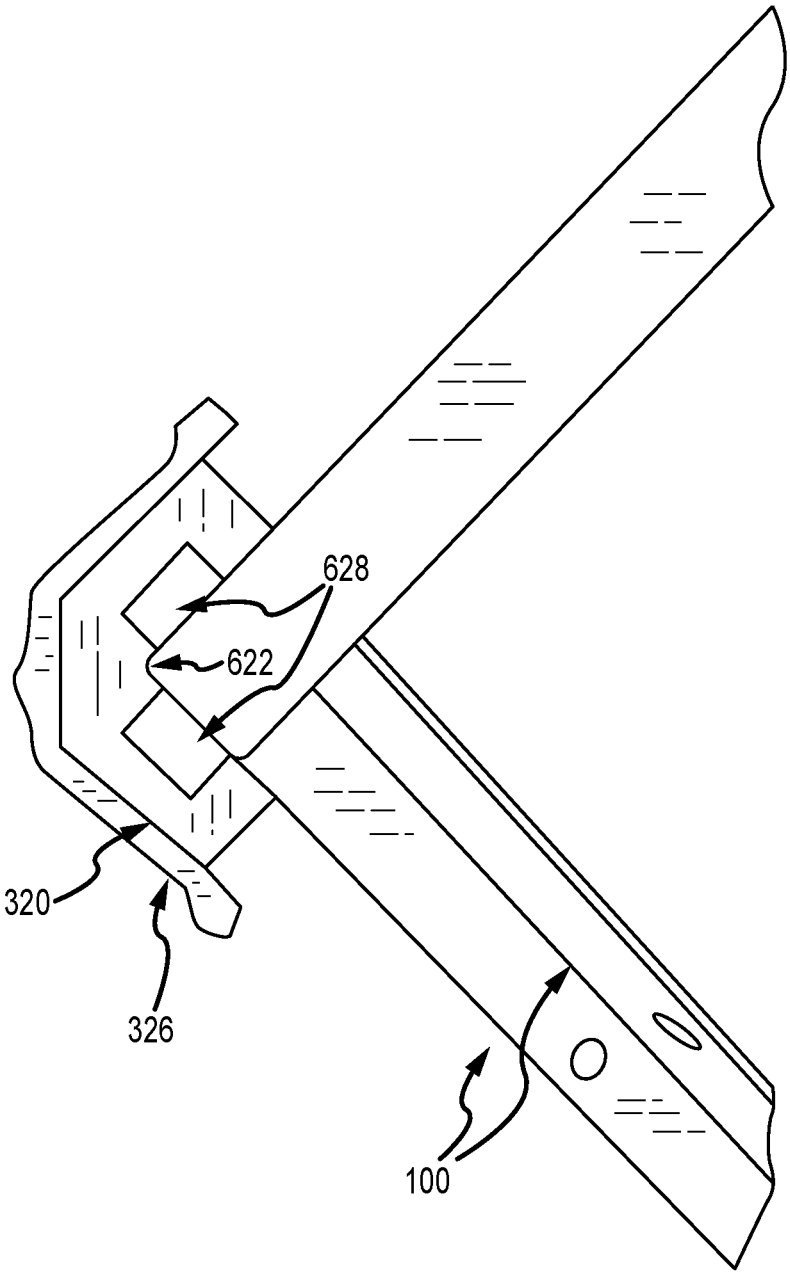
FIG. 6 is a top view of a portion of the columbarium system of FIG. 5 showing attachment of a corner trim extrusion.

FIG. 5 is a side view of the columbarium system 300 of FIG. 3 showing an attachment of one of the corner extrusions 320 to the corner support elements 310. This may be accomplished using a set of fasteners or other techniques. As shown, each corner extrusion 320 extends the full height of the columbarium system 300. FIG. 6 is a top view of a portion of the columbarium system 300 of FIG. 5 showing attachment of the corner trim extrusion 326 upon the corner extrusion 320, and FIG. 7 is an enlarged end view of the combination of the corner extrusion 320 and the corner trim extrusion 326 providing further detail of one useful configuration of these two system components for securing a front or shutter within the system 300.

Figure 7:
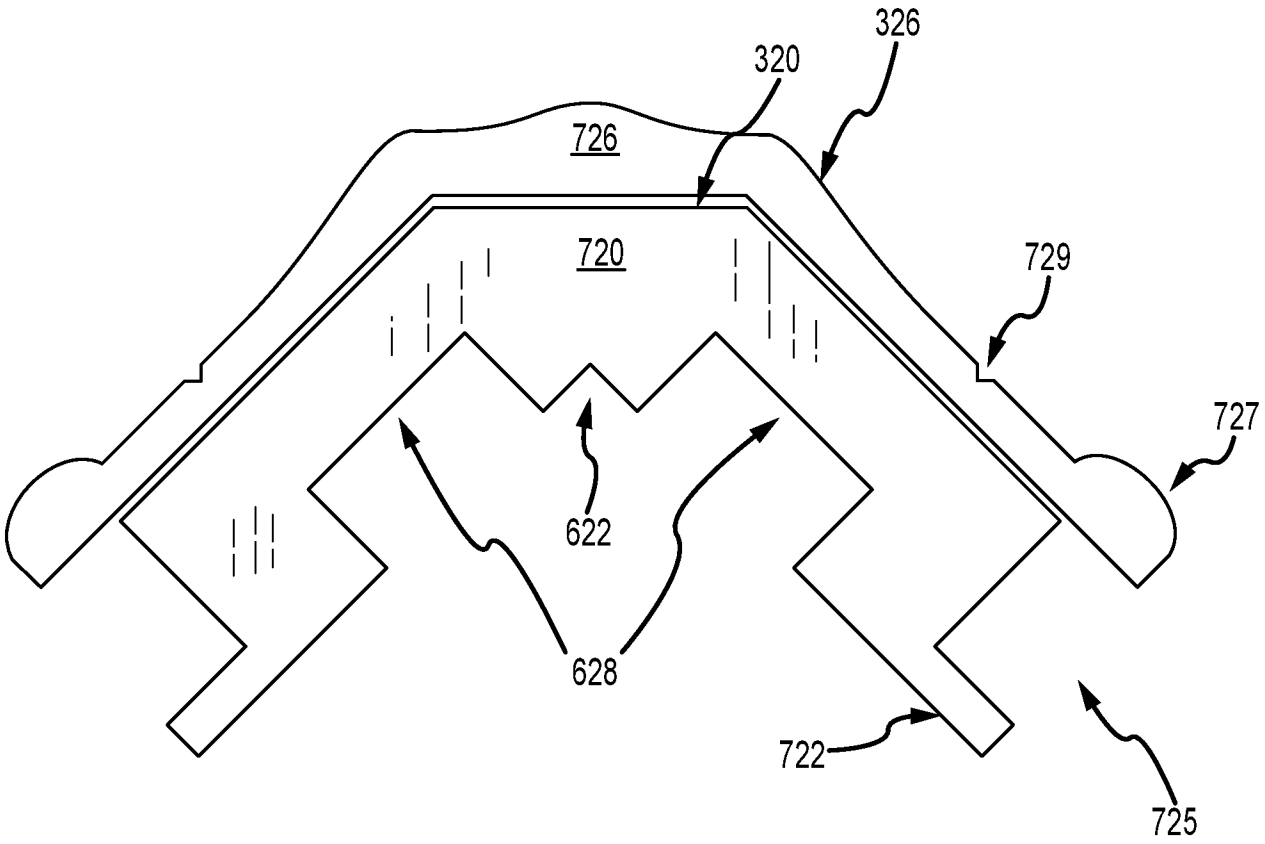
FIG. 7 is an enlarged end view of the combination of the corner extrusion and the corner trim extrusion providing further detail of one useful configuration of these two system components for securing a front or shutter within the system.

As shown in FIGS. 6 and 7, the body 720 of the corner extrusion 320 has a cross-sectional shape generally configured to allow it to mate with and cover a 90-degree corner of the system 300 including with a pair of arms or wings that extend outward a distance along the two walls of the system 300 forming the corner. Each wing/arm of the body 720 is shown to include a recessed surface or channel defined in part by a lip/wall extending outward from the body 720 some distance (e.g., 0.25 to 0.5 inches or the like). The recessed surface 725 defines a slot or channel for receiving an outer edge/side of a front 360.

Note, the extrusion 720 is optionally designed to be symmetric for ease of manufacture and system assembly, and only one of the surfaces 725 and lips 722 would be used to retain a front 360 (i.e., the one facing the front inward on the front of the system 300 as shown in FIG. 5). The body 720 includes a V-shaped groove 622 that is centrally located on an inner surface of the extrusion body 720 for receiving and abuttingly mating with an outer corner of the corner support element 310, as can be seen in FIG. 6. Adjacent both sides of this groove 622, the body 720 may optionally include larger recessed surfaces or groove 628 (which may be rectangular as shown or other shapes), which are provided to hollow out the body 720 to some desired degree so as to save material required to manufacture the extrusion 320.

As shown, the lip 722 extends outward orthogonally from the planar surface of the body 720 providing the recessed surface 725. The corner trim extrusion 326 includes a body 726 with a pair of arms or wings 727 extending outward from a center portion, which will be opposite the groove 622 when installation is completed, to outer ends. The length and shape of the arms/wings 727 are chosen such that the end of each arm/wing 727 extends parallel to the lip/wall 722 a distance (e.g., 0.25 to 0.5 inches or the like). The lip/wall 722 combined with the end of the arm/wing 727 act in combination to retain an edge/side of a front 360 that it received within the recessed space 725 of the body 720 (e.g., within the channel or slot/groove formed by the combination of the body 720, the lip 722, and the end of the wing/arm 727). Screw holes are placed in the continuous groove 729 in the corner trim extrusion 326 (along with matching threaded holes in the body 720) along with tamper-resistant screws may be used to fastened or affix the corner trim extrusion 326 to the corner extrusion 320, which securely holds any received front 360 in place within the recessed surface 725.

Figure 8:
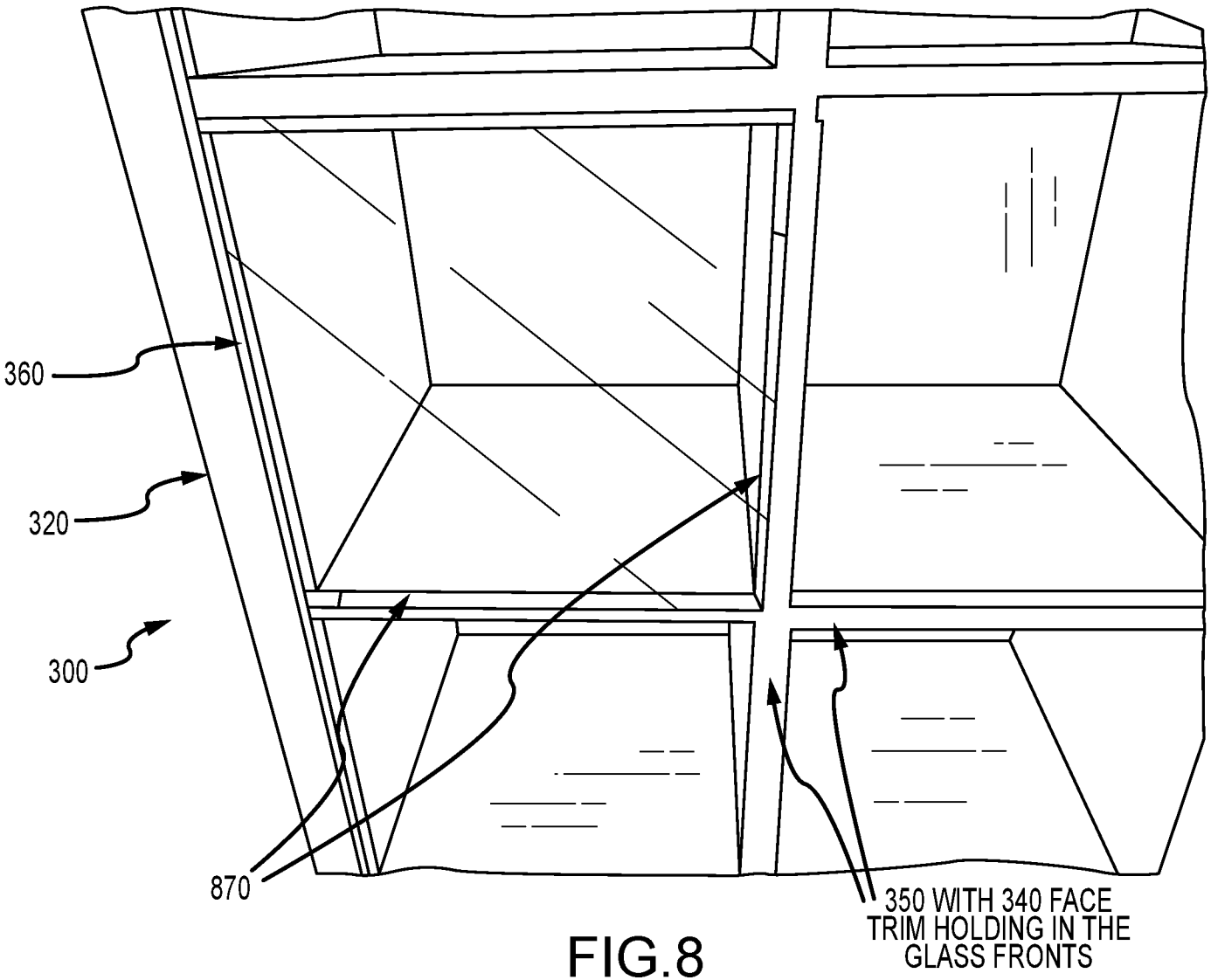
FIG. 8 is a front view of a portion of the columbarium system of FIG. 3 during its assembly including placement of a glass front or shutter over a niche or box.

FIG. 8 is a front view of a portion of the columbarium system 300 of FIG. 3 during its assembly, including placement of a glass front or shutter 360 over a niche or box 305. As shown, three main beam extrusions 350 have been installed on the panels 100 to receive the three interior edges/sides of the glass front 360 while the corner extrusion 320 provides surfaces (as described with reference to FIG. 7) for receiving the fourth and outer edge of the front 360 along with the corner trim extrusion 326 (as will be better understood from review of FIGS. 6 and 7). A sealing member 870, which may take the form of a U-shaped gasket formed of a compressible and/or resilient material (such as a rubber or a plastic with silicone used in one embodiment), is provided so as to extend over the lengths of each edge/side of the front 360 and mate with corresponding ones of the extrusions 320 and 350 in FIG. 8 but also with perimeter extrusion 330 in a full system 300.

Figure 9:
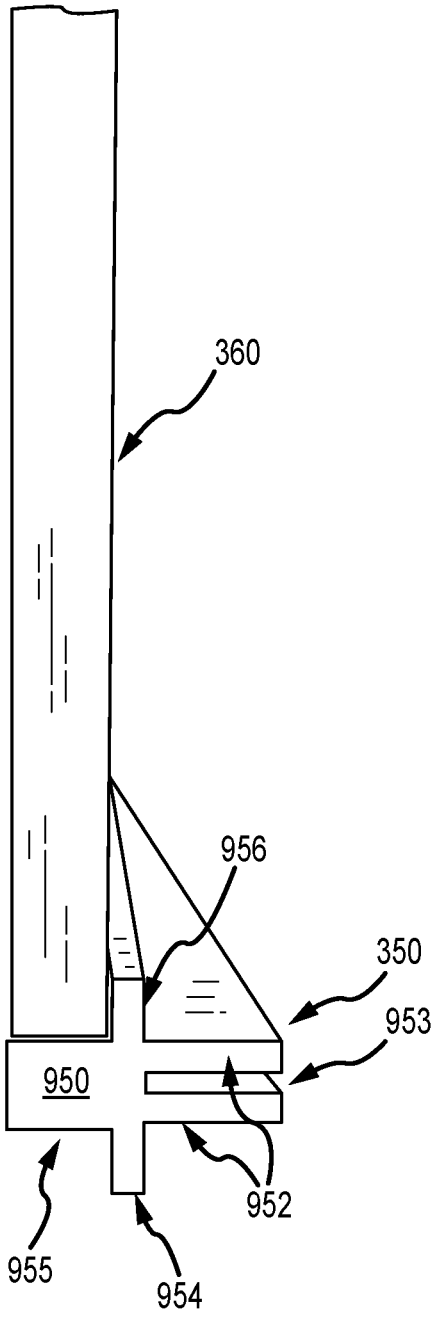
FIG. 9 is an end view of a portion of the columbarium system of FIGS. 3 and 8 showing the combination of or assembly of a main beam extrusion, a face trim extrusion, and a front or shutter without the interlocked plate or panel of the columbarium system.
Figure 10:
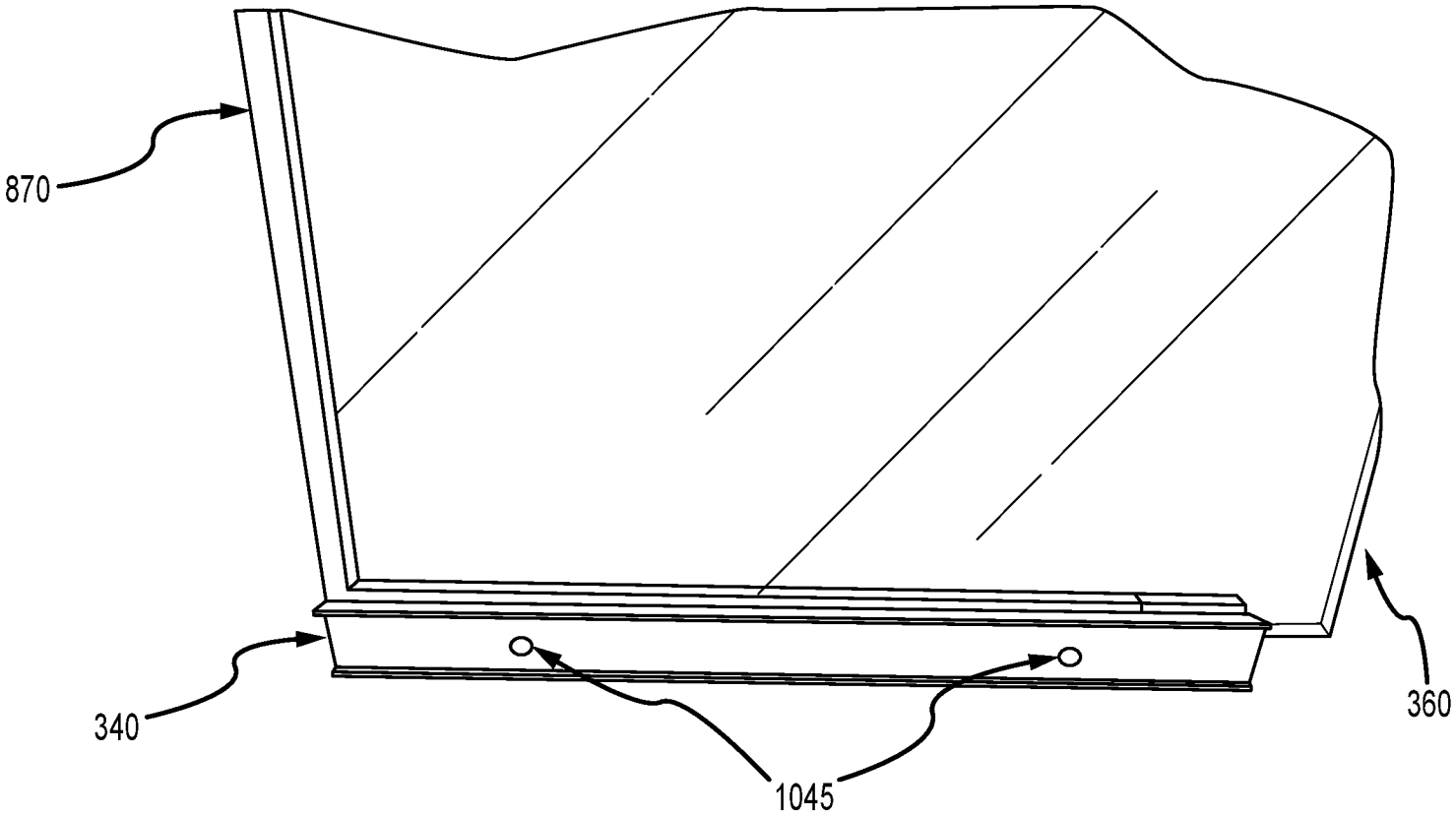
FIG. 10 illustrates a front view of the portion of the columbarium system of FIG. 9 further showing the gasket or sealing member and tamper-resistant or security screws used to apply the face trim extrusion to the main beam extrusion.
Figure 11:
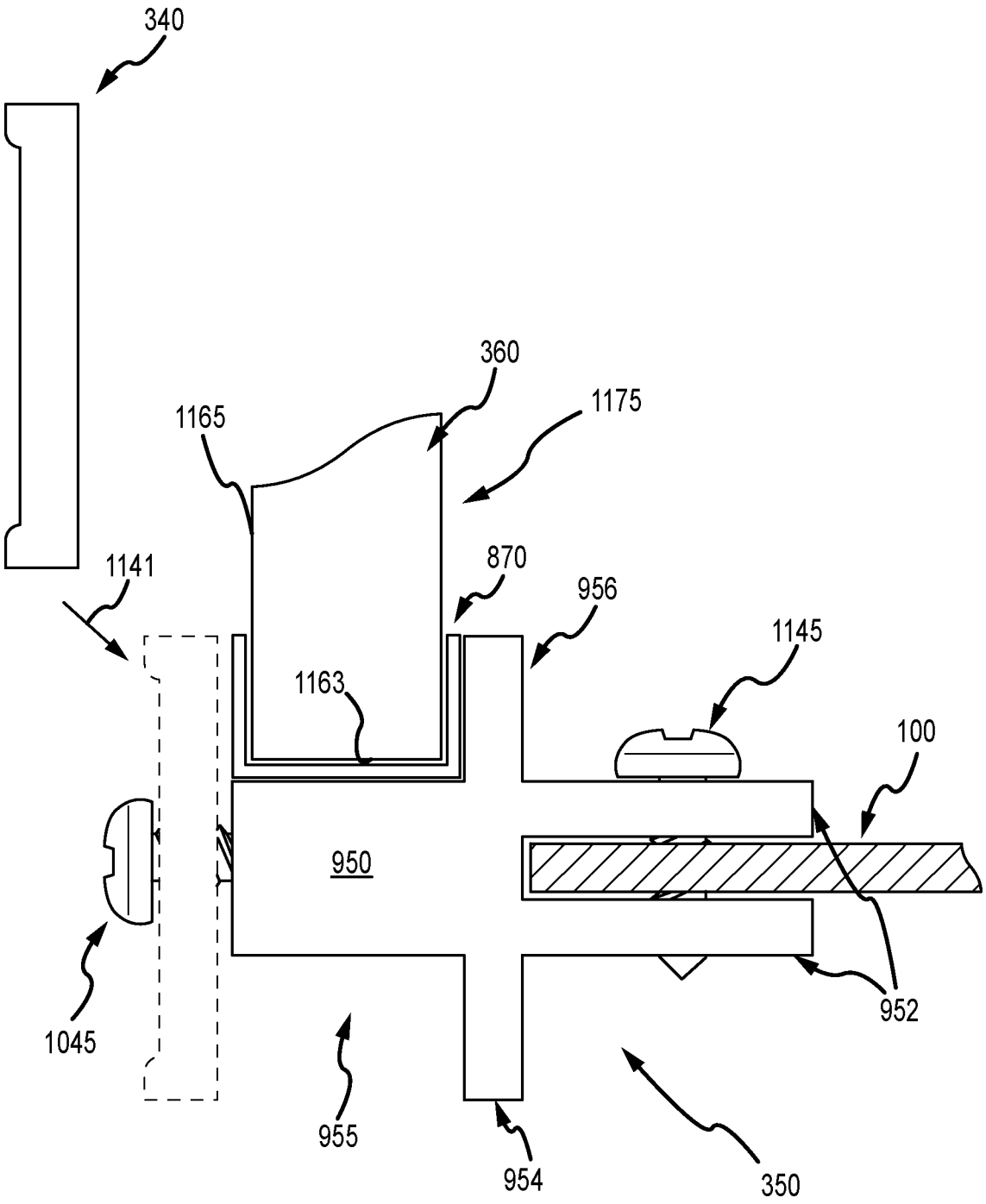
FIG. 11 is an enlarged end sectional view of a portion of the columbarium system of FIG. 3 showing an assembly including a main beam extrusion, a face trim extrusion, a front or shutter with a sealing member disposed between these two extrusions, and the attachment of the main beam extrusion via a fastener to an edge of one of the interlocked plates or panels defining the niche network of boxes of the columbarium system.

FIG. 9 is an end view of a portion of the columbarium system 300 of FIGS. 3 and 8 showing the combination of or assembly of a main beam extrusion 350 and a front or shutter 360 without the interlocked plate or panel (element 100 in FIG. 1) of the columbarium system 300 and prior to application of a face trim extrusion 340. FIG. 10 illustrates a front view of the portion of the columbarium system 300 of FIG. 9 further showing the gasket or sealing member 870 and tamper-resistant or security screws 1045 (e.g., a fastener with a non-conventional head pattern requiring a specialized tool to install and uninstall) used to apply the face trim extrusion 340 to the main beam extrusion 350. FIG. 11 is an enlarged end sectional view of a portion of the columbarium system 300 of FIG. 3 showing an assembly including a main beam extrusion 350, a face trim extrusion 340, a front or shutter 360 with a sealing member 870 disposed between these two extrusions 340 and 350, and the attachment of the main beam extrusion 350 via a fastener 1145 to an edge of one of the interlocked plates or panels 100 defining the honeycomb of niches or boxes 305 of the columbarium system 300.

With reference to FIGS. 9 and 11, the main beam extrusion 350 has a body 950 that is generally rectangular in cross-sectional shape, with two or more threaded holes for receiving the tamper-resistant or security screws 1045 to attach the face trim extrusion 340 to the body 950. This assembly occurs after placement of an outer edge or end 1163 of a glass or granite front/shutter 360 against the body 950 (with the sealing member 870 disposed therebetween).

The body 950 includes a pair of shutter-mating lips or walls (or first and second lips/walls) 954, 956 extending outward from top and bottom planar surfaces of the body 950 to defined front-receiving slots or channels 955. The lips or walls 956 extend the length of the body 950 (into the paper of FIGS. 9 and 11) and outward to height suited for retaining the front 360 (e.g., a height of 0.25 to 0.5 inches or the like) so as to be orthogonal to the planar upper and lower surfaces of the body 950. The lips 954 and 956 are offset a depth from the outer side or edge of the body 950 a distance matching or slightly larger than a combined thickness of the front 360 and two thicknesses of the sealing member 870 to provide full mating with and support of the front 360 in the system 300. Two lips/walls 954, 956 are provided in this embodiment so that the main beam extrusion 350 is symmetric and can be used to receive two fronts 360 in a system 300 rather than just one as shown. When installed, the face trim extrusion 340, with its planar and elongate body has two overhanging portions so as to define the slot/channels 955 for receiving the fronts 360, and these portions will each have a height (often matching that of the lips 954, 956) large enough to securely retain and seal the front 360 in the channel/slot 955 (e.g., 0.25 to 0.5 inches or the like).

The body 950 further includes an elongate slot or groove 953 with a cross-sectional shape and side (e.g., width) chosen to receive a front edge or end of a panel 100. This slot or groove 953 is defined or provided by a second pair of lips or walls 952 extending outward a distance (e.g., 0.5 to 1 inches) from the inner end/side of the body 950 so as to be orthogonal to the lips/walls 954, 956 (so that the front 360 is supported at a 90-degree angle to the plane of the plate/panel 100). The lips or walls 952 are spaced apart a distance that is at least as large as the thickness of the panel/plate 100 (typically with an added amount to provide some clearance and/or account for manufacturing tolerance for the plate 100). The panel 100 includes a number of holes 116 (as seen in FIG. 1) to receive fasteners (e.g., SS screws or the like) 1145 so as to securely mount or affix the main beam extrusion 350 within the system 300.

When installed in a system 300 (see FIGS. 3, 8, 9, and 11), the fronts or shutters 360 each provides a vertical outer cover to one of the niches/boxes 305, with an outward facing (i.e., away from the niche/box 305) side or surface 1165. The fronts 360 may be formed of a stone such as a granite in some cases. In other embodiments, though, the fronts 360 are formed of a transparent glass such as ⅜-inch tempered plate glass or the like. Etching may be used to provide personalized memorial content for each niche 305, while allowing the contents to be viewed through the front 360.

In additional or in other cases, each front 360 may have a photographic or other image provided on the surface/side 1165 or 1175 such as via laser etching or other processes such as printed glass on the surface/side 1175. These images may be standalone images corresponding to each niche 305. In some useful cases, though, the imagery provided on each side/surface 1165 or 1175 of each front 360 is a subset or portion of a larger image (e.g., a religious scene, a patriotic themed image, and so on). The memorializing tag/content on the surface 1165, in these cases, may be visible when viewed from a short distance such as up to 3 to 6 feet or the like while the larger image made up of the combination of all (or a subset) of the fronts 360 of a system 300 would be readily visible from greater distances such as distances greater than 6 feet or the like. The computer file used to etch or paint the content and imagery on each front 360 can be retained, and, if replacement is required such as due to damage of surface 1165 or front 360, a new front 360 can readily be fabricated using this computer file so as to provide a perfect (or nearly so) match to the original, whereas replacements in the past of stone fronts often resulted in a clear mismatch.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

For example, the extrusions may be finished in a variety of ways to create a desired appearance such as with application of an anodized finish to provide a dark or a black appearance on outward facing trim pieces. Also, as described above, the same methodology that is used on the end cap can also be used on the top of the unit by substituting the perimeter extrusion for the corner extrusions. Glass can also be installed on the top of the columbarium system as well. In some embodiment of the columbarium system, a 4-inch thick (or other thickness often greater) stone (e.g., granite or the like) slab is provided on the top, bottom, or top and bottom. In other cases, though, the assembly is installed into an opening that can be created with other building materials such as brick, stone, or wood.

The columbarium system may be configured to be single sided or to be double sided. In some cases, larger panels can be installed on the end cap, and this same principle can be applied on the niche front, which covers the individual niche holes/boxes. This allows the use of larger pieces of glass (or stone) should a design be desired that does not divide the interior space into small box fronts. In this way, a larger image can be displayed on the glass front(s) without all the small vertical and horizontal main beam extrusions extending through this artwork or larger image.

We claim:

1. A columbarium system, comprising:

a plurality of planar panels interlocked together to define a floor, a ceiling, and two spaced-apart and parallel sidewalls of each of a plurality of niches for receiving one or more urns;

a plurality of fronts at a plurality of locations in the columbarium system so that each covers an opening to one of the niches with a planar body extending from the floor to the ceiling and across the two sidewalls;

a plurality of extrusions coupled to the panels and supporting the fronts in the locations so that the planar bodies are orthogonal to the planar panels; and corner support elements received in recessed corners of each of the interlocked panels, wherein the extrusions include a pair of corner extrusions extending along and fastened to a pair of outer and vertical ones of the corner supports, wherein each of the corner extrusions includes a body with a recessed groove for receiving an outer edge of the planar bodies of the fronts positioned over outer side ones of the niches, and wherein the extrusions further comprise a pair of corner trim extrusions each fastened over one of the corner extrusions and with a body including an arm extending over the outer edge of the planar bodies of the fronts to retain the fronts within the recessed groove.

2. The columbarium system of claim 1, wherein each of the panels includes at least one groove at a predefined distance along a length of the panel and extending a distance from an edge of the panel, wherein the panels comprise first and second sets with an equal number of the panels, and wherein the first and second sets are interlocked together by arranging the first set orthogonal to the second set with at least one groove at matching locations.

3. The columbarium system of claim 2, wherein the first and second sets each contain at least three of the panels, wherein the panels have matching widths and lengths, and wherein the distance that each of the grooves extends is one half the width of the panel.

4. The columbarium system of claim 1, further comprising one or more sealing members extending about a periphery of each of the fronts to be disposed between outer edges of the planar body and the extrusions.

5. The columbarium system of claim 4, wherein the one or more sealing members each comprises a U-shaped silicone gasket.

6. The columbarium of claim 1, wherein the extrusions comprise a plurality of main beam extrusions mating with and supporting interior edges of the planar bodies of the fronts, wherein each of the main beam extrusions has a body detachably coupled along a first side with an edge of one of the panels and wherein the body of each of the main beam extrusions further comprises a pair of elongate lips extending outward from opposite sides of the body defining along with planar surfaces of the body a pair of slots each for receiving an edge of the planar body of one of the fronts.

7. The columbarium system of claim 6, wherein the extrusions further comprise a plurality of face trim extrusions each having an elongate, planar body, wherein a number of the face trim extrusions are fastened to the body of the main beam extrusions whereby first and second portions of the elongate, planar body of the face trim extrusions are parallel to and spaced apart a distance from the lips of the body of the main beam extrusions to define a wall of each of the pair of slots for receiving one of the fronts.

8. The columbarium system of claim 7, wherein the face trim extrusions are coupled to the body of the main beam extrusion using two or more tamper-resistant screws that extend through the elongate, planar body of the face trim extrusions into the body of the main beam extrusion.

9. The columbarium system of claim 1, wherein the extrusions comprise at least two perimeter extrusions and a plurality of face trim extrusions, wherein each of the perimeter extrusions is provided at one of a top edge, a bottom edge, or a side edge of the columbarium system, wherein each of the perimeter extrusions includes a body having a first lip extending outward from the body and being affixed to a front edge of one of the panels and having a second lip extending outward from the body to be orthogonal to the first lip and to define along with a planar outer surface a slot for receiving an edge of the planar body of one of the fronts, and wherein the face trim extrusions each has an elongate, planar body that is coupled to a recessed surface on the body of one of the perimeter extrusions whereby a portion of the elongate, planar body of the face trim extrusion is parallel to and spaced apart a distance from the second lip of the body of the perimeter extrusion to define a wall of the slot for receiving the edge of the planar body of one of the fronts.

10. The columbarium system of claim 1, wherein an outer surface of each of the planar bodies is etched or painted with a predefined portion of a larger image displayed by a combination of all the outer surfaces of the fronts.

11. A columbarium system, comprising:

a plurality of niches for receiving one or more urns;

a plurality of glass or stone fronts each covering an opening to one of the niches, provided on a front edge of the columbarium system, with a planar body;

to support the fronts, a set of two or more extrusions with differing cross sectional body configurations, the set of the extrusions including a plurality of main beam extrusions mating with and supporting interior edges of the planar bodies of the fronts, wherein each of the main beam extrusions has a body detachably coupled along a first side with an edge of a panel defining the niches and wherein the body of each of the main beam extrusions further comprises a pair of elongate lips extending outward from opposite sides of the body defining, along with planar surfaces of the body, channels receiving an edge of the planar body of one of the fronts; and corner support elements received in recessed corners of each of the panels defining the niches, wherein the set of the extrusions includes a pair of corner extrusions extending along and fastened to a pair of outer and vertical ones of the corner supports, wherein each of the corner extrusions includes a body with a recessed groove for receiving an outer edge of the planar bodies of the fronts positioned over outer side ones of the niches, and wherein the extrusions further comprise a pair of corner trim extrusions each fastened over one of the corner extrusions and with a body including an arm extending over the outer edge of the planar bodies of the fronts to retain the fronts within the recessed groove.

12. The columbarium system of claim 11, wherein the set of the extrusions further comprises a plurality of face trim extrusions each having an elongate, planar body, wherein a number of the face trim extrusions are fastened to the body of the main beam extrusions whereby first and second portions of the elongate, planar body of the face trim extrusions are parallel to and spaced apart a distance from the lips of the body of the main beam extrusions to define a wall of each of the pair of slots for receiving one of the fronts.

13. The columbarium system of claim 12, wherein the face trim extrusions are coupled to the body of the main beam extrusion using two or more tamper-resistant screws that extend through the elongate, planar body of the face trim extrusions into the body of the main beam extrusion.

14. The columbarium system of claim 11, wherein the set of the extrusions comprises at least two perimeter extrusions and a plurality of face trim extrusions, wherein each of the perimeter extrusions is provided at one of a top edge, a bottom edge, or a side edge of the columbarium system, wherein each of the perimeter extrusions includes a body having a first lip extending outward from the body and being affixed to a front edge of one of the panels defining the niches and having a second lip extending outward from the body to be orthogonal to the first lip and to define along with a planar outer surface a slot for receiving an edge of the planar body of one of the fronts, and wherein the face trim extrusions each has an elongate, planar body that is coupled to a recessed surface on the body of one of the perimeter extrusions whereby a portion of the elongate, planar body of the face trim extrusion is parallel to and spaced apart a distance from the second lip of the body of the perimeter extrusion to define a wall of the slot for receiving the edge of the planar body of one of the fronts.

15. A columbarium system, comprising:

a plurality of planar panels interlocked together to define a network of niches;

a plurality of fronts each enclosing one of the niches, wherein an outer surface of each of the fronts is etched or an inner surface of each of the fronts is painted with a predefined portion of an image displayed by a combination of the outer or inner surfaces of the fronts;

a set of extrusions coupled to the panels and supporting the fronts to be orthogonal to the planar panels, wherein the set of extrusions includes a pair of perimeter extrusions affixed to the planar panels at an upper and a bottom edge, a pair of corner extrusions affixed to the planar panels at two front corners, and a plurality of main beam extrusions each extending along each of the interior edges of the fronts; and corner support elements received in recessed corners of each of the interlocked panels, wherein the corner extrusions extend along and are fastened to a pair of outer and vertical ones of the corner supports, wherein each of the corner extrusions includes a body with a recessed groove for receiving an outer edge of the planar bodies of the fronts positioned over outer side ones of the niches, and wherein the set of extrusions further comprises a pair of corner trim extrusions each fastened over one of the corner extrusions and with a body including an arm extending over the outer edge of the planar bodies of the fronts to retain the fronts within the recessed groove.

16. The columbarium system of claim 15, wherein each of the panels includes at least one groove at a predefined distance along a length of the panel and extending a distance from an edge of the panel, wherein the panels comprise first and second sets with an equal number of the panels, wherein the first and second sets are interlocked together by arranging the first set orthogonal to the second set with the at least one groove at matching locations, wherein the first and second sets each contain at least three of the panels, wherein the panels have matching widths and lengths, and wherein the distance that each of the grooves extends is one half the width of the panel.

17. The columbarium system of claim 15, further comprising one or more sealing members extending about a periphery of each of the fronts to be disposed between outer edges of the planar body and the extrusions, and wherein the one or more sealing members each comprises a U-shaped gasket.

18. The columbarium of claim 15, wherein the main beam extrusions mate with and support interior edges of the planar bodies of the fronts, wherein each of the main beam extrusions has a body detachably coupled along a first side with an edge of one of the panels and wherein the body of each of the main beam extrusions further comprises a pair of elongate lips extending outward from opposite sides of the body defining along with planar surfaces of the body a pair of slots each for receiving an edge of the planar body of one of the fronts.

19. The columbarium system of claim 18, wherein the set of extrusions further comprises a plurality of face trim extrusions each having an elongate, planar body, wherein a number of the face trim extrusions are fastened to the body of the main beam extrusions whereby first and second portions of the elongate, planar body of the face trim extrusions are parallel to and spaced apart a distance from the lips of the body of the main beam extrusions to define a wall of each of the pair of slots for receiving one of the fronts.

20. The columbarium system of claim 19, wherein the face trim extrusions are coupled to the body of the main beam extrusion using two or more tamper-resistant screws that extend through the elongate, planar body of the face trim extrusions into the body of the main beam extrusion.

21. The columbarium system of claim 15, wherein the set of extrusions further comprises a plurality of face trim extrusions, wherein each of the perimeter extrusions includes a body having a first lip extending outward from the body and being affixed to a front edge of one of the panels and having a second lip extending outward from the body to be orthogonal to the first lip and to define along with a planar outer surface a slot for receiving an edge of the planar body of one of the fronts, and wherein the face trim extrusions each has an elongate, planar body that is coupled to a recessed surface on the body of one of the perimeter extrusions whereby a portion of the elongate, planar body of the face trim extrusion is parallel to and spaced apart a distance from the second lip of the body of the perimeter extrusion to define a wall of the slot for receiving the edge of the planar body of one of the fronts.

22. A columbarium system, comprising:

a plurality of planar panels interlocked together to define a floor, a ceiling, and two spaced-apart and parallel sidewalls of each of a plurality of niches for receiving one or more urns;

a plurality of fronts at a plurality of locations in the columbarium system so that each covers an opening to one of the niches with a planar body extending from the floor to the ceiling and across the two sidewalls; and a plurality of extrusions coupled to the panels and supporting the fronts in the locations so that the planar bodies are orthogonal to the planar panels, wherein the extrusions comprise a plurality of main beam extrusions mating with and supporting interior edges of the planar bodies of the fronts, wherein each of the main beam extrusions has a body detachably coupled along a first side with an edge of one of the panels, wherein the body of each of the main beam extrusions further comprises a pair of elongate lips extending outward from opposite sides of the body defining along with planar surfaces of the body a pair of slots each for receiving an edge of the planar body of one of the fronts, wherein the extrusions further comprise a plurality of face trim extrusions each having an elongate, planar body, and wherein a number of the face trim extrusions are fastened to the body of the main beam extrusions, whereby first and second portions of the elongate, planar body of the face trim extrusions are parallel to and spaced apart a distance from the lips of the body of the main beam extrusions to define a wall of each of the pair of slots for receiving one of the fronts extending a length at least as long as a received side of one of the fronts.

23. The columbarium system of claim 22, further comprising one or more sealing members extending about a periphery of each of the fronts to be disposed between outer edges of the planar body and the extrusions.

24. The columbarium system of claim 23, wherein the one or more sealing members each comprises a U-shaped silicone gasket.

25. The columbarium system of claim 22, wherein the face trim extrusions are coupled to the body of the main beam extrusion using two or more tamper-resistant screws that extend through the elongate, planar body of the face trim extrusions into the body of the main beam extrusion.

26. The columbarium system of claim 22, wherein the extrusions comprise at least two perimeter extrusions and a plurality of face trim extrusions, wherein each of the perimeter extrusions is provided at one of a top edge, a bottom edge, or a side edge of the columbarium system, wherein each of the perimeter extrusions includes a body having a first lip extending outward from the body and being affixed to a front edge of one of the panels and having a second lip extending outward from the body to be orthogonal to the first lip and to define along with a planar outer surface a slot for receiving an edge of the planar body of one of the fronts, and wherein the face trim extrusions each has an elongate, planar body that is coupled to a recessed surface on the body of one of the perimeter extrusions whereby a portion of the elongate, planar body of the face trim extrusion is parallel to and spaced apart a distance from the second lip of the body of the perimeter extrusion to define a wall of the slot for receiving the edge of the planar body of one of the fronts.

27. The columbarium system of claim 22, wherein an outer surface of each of the planar bodies is etched or painted with a predefined portion of a larger image displayed by a combination of all the outer surfaces of the fronts.

28. A columbarium system, comprising:

a plurality of planar panels interlocked together to define a floor, a ceiling, and two spaced-apart and parallel sidewalls of each of a plurality of niches for receiving one or more urns;

a plurality of fronts at a plurality of locations in the columbarium system so that each covers an opening to one of the niches with a planar body extending from the floor to the ceiling and across the two sidewalls;

a plurality of extrusions coupled to the panels and supporting the fronts in the locations so that the planar bodies are orthogonal to the planar panels, wherein the extrusions comprise at least two perimeter extrusions and a plurality of face trim extrusions, wherein each of the perimeter extrusions is provided at one of a top edge, a bottom edge, or a side edge of the columbarium system, wherein each of the perimeter extrusions includes a body having a first lip extending outward from the body and being affixed to a front edge of one of the panels and having a second lip extending outward from the body to be orthogonal to the first lip and to define along with a planar outer surface a slot for receiving an edge of the planar body of one of the fronts, and wherein the face trim extrusions each has an elongate, planar body that is coupled to a recessed surface on the body of one of the perimeter extrusions whereby a portion of the elongate, planar body of the face trim extrusion is parallel to and spaced apart a distance from the second lip of the body of the perimeter extrusion to define a wall of the slot for receiving the edge of the planar body of one of the fronts extending a length at least as long as a received side of one of the fronts.

29. The columbarium system of claim 28, further comprising one or more sealing members extending about a periphery of each of the fronts to be disposed between outer edges of the planar body and the extrusions.

30. The columbarium system of claim 29, wherein the one or more sealing members each comprises a U-shaped silicone gasket.

31. The columbarium of claim 28, wherein the extrusions comprise a plurality of main beam extrusions mating with and supporting interior edges of the planar bodies of the fronts, wherein each of the main beam extrusions has a body detachably coupled along a first side with an edge of one of the panels and wherein the body of each of the main beam extrusions further comprises a pair of elongate lips extending outward from opposite sides of the body defining along with planar surfaces of the body a pair of slots each for receiving an edge of the planar body of one of the fronts.

32. The columbarium system of claim 28, wherein each of the face trim extrusions are coupled to the body of the perimeter extrusions using two or more tamper-resistant screws that extend through the elongate, planar body of the face trim extrusions into the body of one of the perimeter extrusions.

33. The columbarium system of claim 28, wherein an outer surface of each of the planar bodies is etched or painted with a predefined portion of a larger image displayed by a combination of all the outer surfaces of the fronts.

* * * * *